US011542935B2

(12) United States Patent
Oberbeck et al.

(10) Patent No.: US 11,542,935 B2
(45) Date of Patent: Jan. 3, 2023

(54) GAS RECIRCULATION DEVICE AND SYSTEM HAVING SUCH A DEVICE

(71) Applicant: PFEIFFER VACUUM GMBH, Asslar (DE)

(72) Inventors: Sebastian Oberbeck, Weilburg (DE); Jonas Becker, Wettenberg (DE)

(73) Assignee: PFEIFFER VACUUM GMBH, Asslar (DE)

( * ) Notice: Subject to any disclaimer, the term of this patent is extended or adjusted under 35 U.S.C. 154(b) by 0 days.

(21) Appl. No.: 16/923,191

(22) Filed: Jul. 8, 2020

(65) Prior Publication Data

US 2021/0131440 A1 May 6, 2021

(30) Foreign Application Priority Data

Nov. 6, 2019 (EP) ..... 19207550

(51) Int. Cl.

| | |
|---|---|
| ***F04D 19/02*** | (2006.01) |
| ***F04D 29/046*** | (2006.01) |
| ***F04D 29/08*** | (2006.01) |
| ***F04B 43/073*** | (2006.01) |

(52) U.S. Cl.

CPC ..... *F04B 43/0736* (2013.01); *F04D 19/022* (2013.01); *F04D 29/046* (2013.01); *F04D 29/083* (2013.01)

(58) Field of Classification Search

CPC ..... F04D 23/008; F04D 5/002; F04D 13/06; F04D 13/0606; F04D 19/042

See application file for complete search history.

(56) References Cited

U.S. PATENT DOCUMENTS

| | | | | |
|---|---|---|---|---|
| 4,817,111 A * | 3/1989 | Nilsen | F04D 23/008 372/58 |
| 5,291,087 A * | 3/1994 | Pollick | F04D 23/008 310/86 |
| 5,299,908 A | 4/1994 | Robbie | |
| 5,468,119 A * | 11/1995 | Huebel | F04D 29/188 415/55.1 |
| 6,779,968 B1 * | 8/2004 | Rietschle | F04D 23/008 415/55.1 |
| 7,425,113 B2 * | 9/2008 | Peterson | F04D 29/188 415/53.1 |

(Continued)

FOREIGN PATENT DOCUMENTS

| | | |
|---|---|---|
| DE | 1 528 881 A1 | 12/1970 |
| DE | 2559667 A1 | 11/1977 |

(Continued)

OTHER PUBLICATIONS

Office Action received for the Japanese Patent Application No. 2020-072213, dated Jun. 16, 2021, 16 pages (11 pages of English translation & 5 pages of Original document).

(Continued)

*Primary Examiner* — Topaz L. Elliott
*Assistant Examiner* — Jackson N Gillenwaters
(74) *Attorney, Agent, or Firm* — Oblon, McClelland, Maier & Neustadt, L.L.P.

(57) ABSTRACT

The invention relates to a recirculation device for a gas of a process device, said recirculation device comprising a recirculation pump, wherein the recirculation pump is a side channel pump.

15 Claims, 6 Drawing Sheets

(56) References Cited

U.S. PATENT DOCUMENTS

| | | | | |
|---|---|---|---|---|
| 7,455,496 | B2 * | 11/2008 | Motojima | F04D 29/188 415/55.1 |
| 8,123,412 | B2 * | 2/2012 | Koci | F16C 33/62 384/470 |
| 10,605,270 | B2 * | 3/2020 | Boutros-Mikhail | F04D 29/26 |
| 2004/0219401 | A1 * | 11/2004 | Hobmeyr | H01M 8/04179 429/415 |
| 2007/0224031 | A1 * | 9/2007 | Cattani | F04D 23/008 415/55.1 |
| 2011/0003238 | A1 * | 1/2011 | Harr | H01M 8/04186 429/512 |
| 2011/0029133 | A1 | 2/2011 | Okazaki et al. | |
| 2012/0241529 | A1 * | 9/2012 | Wetzl | F04D 23/008 237/12.3 C |
| 2013/0164647 | A1 * | 6/2013 | Kobayashi | F04D 13/0606 429/434 |
| 2015/0125324 | A1 * | 5/2015 | Sanford | F04D 25/026 417/420 |
| 2016/0001401 | A1 * | 1/2016 | Dimter | B29C 64/153 219/76.12 |
| 2018/0017084 | A1 | 1/2018 | Boutros-Mikhail et al. | |
| 2019/0277233 | A1 * | 9/2019 | Clements | F04D 15/0209 |

FOREIGN PATENT DOCUMENTS

| | | | |
|---|---|---|---|
| DE | 3245958 | A1 | 6/1984 |
| DE | 69113616 | T2 | 4/1996 |
| DE | 198 19 267 | A1 | 11/1999 |
| DE | 198 19 267 | B4 | 11/1999 |
| DE | 199 13 950 | A1 | 9/2000 |
| DE | 203 05 603 | U1 | 7/2003 |
| DE | 203 06 448 | U1 | 10/2003 |
| DE | 103 25 077 | A1 | 10/2004 |
| DE | 103 27 536 | A1 | 1/2005 |
| DE | 10 2004 044 068 | A1 | 3/2006 |
| DE | 10 2005 008 388 | A1 | 8/2006 |
| DE | 20 2006 011 858 | U1 | 1/2008 |
| DE | 10 2007 046 014 | A1 | 4/2009 |
| DE | 10 2008 015 538 | A1 | 10/2009 |
| DE | 10 2009 019 838 | A1 | 12/2009 |
| DE | 10 2009 052 180 | A1 | 5/2011 |
| DE | 10 2012 207 145 | A1 | 10/2013 |
| DE | 10 2014 106 440 | A1 | 11/2015 |
| DE | 10 2015 111 469 | A1 | 1/2017 |
| DE | 10 2016 116 813 | A1 | 3/2017 |
| DE | 102017212864 | A1 | 2/2018 |
| DE | 10 2017 129 477 | A1 | 6/2019 |
| DE | 10 2018 200 637 | A1 | 7/2019 |
| EP | 0693325 | A2 | 1/1996 |
| EP | 1114017 | B1 | 3/2003 |
| EP | 1 724 469 | A2 | 11/2006 |
| EP | 2045358 | A2 | 4/2009 |
| EP | 2 835 536 | A2 | 2/2015 |
| EP | 3176527 | A1 | 6/2017 |
| JP | S62271992 | A | 11/1987 |
| JP | 2000337284 | A | 12/2000 |
| JP | 2002540350 | A | 11/2002 |
| JP | 2004150298 | A | 5/2004 |
| JP | 2007247421 | A | 9/2007 |
| JP | 2010265894 | A | 11/2010 |
| JP | 2016516886 | A | 6/2016 |
| JP | 2016223427 | A | 12/2016 |
| JP | 2017145785 | A | 8/2017 |
| JP | 2017152132 | A | 8/2017 |
| WO | WO 85/00536 | A1 | 2/1985 |
| WO | WO 98/04835 | A1 | 2/1998 |
| WO | WO 2007/082640 | A1 | 7/2007 |
| WO | WO 2015/169496 | A1 | 11/2015 |
| WO | WO 2017/063662 | A1 | 4/2017 |
| WO | 2017090510 | A1 | 6/2017 |
| WO | 2019048140 | A1 | 3/2019 |
| WO | 2020099213 | A1 | 5/2020 |

OTHER PUBLICATIONS

EP Extended Search Report from Corresponding EP Application No. 19207550.5-1004; dated Dec. 12, 2019.

JP Extended Search Report from Corresponding JP Application No. 2020-072213; dated Feb. 14, 2022.

Unsolicited third-party communication, received Mar. 21, 2022 - BECKER document, (Undated) 35 pages. The filing of this IDS does not constitute—neither explicitly nor implicitly—an admission by the Applicant as to the prior publication of the BECKER NPL, i.e., the Applicant does not acknowledge that this BECKER NPL represents prior art.

European Opposition Communication dated Oct. 14, 2022, in European Patent Application No. 19207550.5 filed Nov. 6, 2019, citing document Nos. 2, 14-29, 40-41 and 43-44 therein, 52 pages.

European Opposition Communication dated Oct. 14, 2022, in European Patent Application No. 19207550.5 filed Nov. 6, 2019, citing document Nos. 1,3-4, 6-8, 11-13, 16 and 21 therein, 36 pages.

Instructions for Use (Gebrauchsanleitung) 6.250/1-004, siehe 2.1 (Anlage Ripa 2), Becker, 2010, 24 pages (with English Translation).

Datenblatt SV 300/1, Side Channel Blowers, Becker, 2018, 2 total pages (with English Translation).

Screenshot Bildschirmfoto Wayback Machine Gebr. Becker Homepage, Side Channel Blowers, 3 total pages (with English Translation).

Excerpt (Auszug) aus Technology Scout, 2017, 50 total pages (with English Abstract).

Pumps and compressors for the world market 2012 with compressed air and vacuum Technology, 2012, 23 total pages (with English Abstract).

Auszug der Betriebsanleitung SLM280 2.0, Operating Manual, "Selective Laser Melting Machine/Powder Supply Unit (PSV)", SLM Solutions, 2018, 26 total pages (with English Translation).

Auftragsbestatigung und Lieferschein der Bestellung PO1971, Order Confirmation, SLM Solutions, 2019, 4 total pages.

Auftragsbeslaligung und Lieferschein der Bestellung 3769/2159-16540 (in English: Order confirmation and delivery note of order 3769/2159-16540), SLM Solutions, 2018, 5 total pages.

Ersatzteilbroschiire: Booklet for Spare Parts, Becker, 2018, 7 total pages.

Variair SV 300/2, Side Channel Compressor, Becker, 2019, 5 total pages (with English Abstract).

Article: Becker to showcase gas-tight blowers for metal Additive Manufacturing at Formnext 2018, 3 total pages.

"Blowers for demanding additive manufacturing processes", Gebr. Becker/Formnext, 2018, 1 total page.

Wikipedia: Seitenkanalverdichter (Wikipedia Entry: side channel compressor), 2022, 3 total pages (with English Translation).

* cited by examiner

GAS RECIRCULATION DEVICE AND SYSTEM HAVING SUCH A DEVICE

CROSS-REFERENCE TO RELATED APPLICATION

This application claims priority to European application no. EP 19207550.5, filed Nov. 6, 2019, the content of which is incorporated by reference herein in its entirety.

FIELD OF INVENTION

The present invention relates to a recirculation device for a gas of a process device, said recirculation device comprising a recirculation pump. The invention furthermore relates to a system comprising a process device having a space and/or a line for receiving a gas and to a recirculation device for the gas.

BACKGROUND OF PRIOR ART

Gas recirculation is required in various technical areas. Gas is typically removed from a larger volume in which a process takes place, is prepared in a suitable manner, and is then supplied to the process again. To overcome the pressure losses that arise in the gas guides and a possibly present preparation, a pump is used that can provide the necessary excess pressure and volume flow. In this respect, the properties of the gases or gas mixtures, the general pressure level, the gas volume, and the gas temperature are some, but not all of the parameters that have to be taken into account.

Diaphragm compressors or rotary vane compressors, sometimes also dual-shaft compressors such as Roots compressors, screw compressors or claw compressors (the terms "compressor" and "pump" are used synonymously herein), are typically present in such known recirculation devices.

Diaphragm compressors and rotary vane compressors are subject to friction and wear and therefore require regular maintenance. Diaphragm compressors have a pulsating conveying due to discrete suction space volumes; poor scalability due to a limited rotational speed variability and to discrete volumes; wear at bearings, diaphragms, crankshafts, connecting rods and valves; and vibrations due to the oscillating movement of diaphragms and connecting rods. Depending on their design, rotary vane compressors have oil or abrasion in the suction space, wherein both can be disadvantageous for the processes. The restricted scalability as a result of the rotational speed due to discrete volumes and friction in the system can likewise be disadvantageous.

Roots compressors, screw compressors or claw compressors are less subject to wear than contactless pumps; however, the manufacturing costs of these dual-shaft systems having synchronous gears are considerably higher. Roots compressors generally have a relatively large construction size and high costs due to the dual-shaft design with the necessary synchronization of the shafts. The compression ratio is relatively low with a relatively large suction space. Roots compressors are thereby only scalable to a limited degree via the rotational speed variation. The efficiency is furthermore relatively low due to considerable gap losses. In addition, the shaft leadthroughs would have to be sealed in a complex and/or expensive manner.

Thus, a large number of pumps for gas recirculation are known in the prior art that each have specific advantages, but also, as demonstrated, numerous disadvantages.

SUMMARY OF INVENTION

It is an object of the invention to provide a gas recirculation device that has a simple and inexpensive design with good efficiency. The disadvantages demonstrated above should in particular also be overcome.

This object is satisfied by a recirculation device in accordance with claim 1 and in particular in that the recirculation pump is a side channel pump. The side channel pump has a particularly good effectiveness in the manufacture and operation in a simple and cost-effective design.

The side channel technology is in particular advantageous due to its flow dynamic properties; to the almost mechanically friction-free operation; to its adaptability to different processes via the rotational speed, side channel geometry, rotor blade geometry and number of stages; and to a large number of available material combinations. The side channel pump substantially works contactlessly, thus enabling long service lives, and is virtually wear-free. The side channel pump allows a demand-based adaptation and a precise setting of the pressure provided and of the flow rate, e.g. by a selection of a single-stage or multi-stage design and/or by a rotational speed regulation. Furthermore, a rotor blade shape and a side channel shape can be adapted to the gases to be conveyed. Correspondingly resistant materials can be used for corrosive media.

The side channel pump in particular has only one shaft. A multi-stage side channel pump can also be manufactured with a single shaft, for example having a plurality of rotors that are arranged on one and the same shaft. The side channel pump is thus particularly easy and inexpensive to manufacture.

Until now, a selection has been made from a large number of pumps depending on the application so that the specific advantages were utilized. The recirculation device in accordance with the invention now allows a particularly good range of applications with a simple design and low manufacturing and operating costs.

The recirculation device can, for example, have a preparation device for the gas. The preparation device can, for example, be configured to purify the gas, to separate or to enrich certain gas portions, to add something to the gas, or to make the gas usable for a process or improve it in some other way.

In general, the gas can also be only partly returned into the process device. The entire removed gas can, for example, be returned or only some of it, in particular a certain component.

The gas can, for example, include or be hydrogen, a temperature control medium, in particular a cooling medium, and/or CO2. Furthermore, the gas can, for example, include or be air, helium, and/or neon. In general, the gas is in particular at least present in the process device, in particular in a space or in a line, during operation.

The side channel pump can, for example, comprise at least one rotor having a plurality of rotor blades. Provision can advantageously be made that the rotor blades are each at least one of straight, oblique, arrow-shaped, curved, divided or connected in a direction of movement, or inclined to the front or to the rear in a direction of movement. Combinations of these features per rotor blade, per rotor, and/or per pump stage are also advantageous.

An intermediate space between two rotor blades adjacent in the direction of movement can, for example, be flat or have a pointed roof-shaped structure. A flat structure is particularly simple to manufacture. A pointed roof-shaped structure supports a vortex formation of the gas to be conveyed in the side channel and thus the pumping effect. In this respect, a ridge edge or a ridge region can, for example, extend substantially in parallel with the direction of movement of the blades and/or can connect the blades or extend obliquely, in particular sloping down from one blade to a base of an adjacent blade. The pointed roof-shaped structure can have planar and/or curved side surfaces, in particular concave side surfaces.

Provision can, for example, be made that at least one side channel of the side channel pump has a respective at least substantially circular, oval, elliptical, rectangular, or egg-shaped cross-sectional geometry. Further cross-sectional geometries are also possible, for instance, rounded and/or trapezoidal cross-sections. In general, the cross-sectional geometry of a side channel can e.g. be symmetrical or also asymmetrical.

In accordance with an embodiment, a side channel of the side channel pump tapers in its cross-section in a flow direction, in particular from an inlet of the side channel up to an outlet of the side channel. A particularly good compression can hereby be achieved in a simple manner.

In general, a side channel can, for example, be interrupted by a breaker between the outlet and the inlet of the side channel or the outlet and inlet can be separated from one another by a breaker.

The side channel pump can preferably have a single-stage or multi-stage design and can in particular be designed with two, three, four, or five stages. The stages can, for example, be arranged axially and/or radially offset. The performance data of the side channel pump, in particular the exit pressure and the gas flow, can thus be particularly simply adapted to a respective application.

The side channel pump can, for example, have a seal, in particular a hermetic seal, in particular sealing a sealed region with respect to the environment. In this respect, the parts of the pump that are movable to produce the pumping effect, in particular the shaft, the rotor, the motor rotor and/or movable bearing parts, can be arranged within the sealed region, that is in particular behind the seal from the point of view of the environment. The side channel pump can thus be configured in a simple manner for the use with corrosive media. The movable parts can, for example, be encapsulated for the purpose of sealing.

In accordance with a further development, the side channel pump has a motor having a rotor, wherein the rotor is arranged in a space that is sealed, in particular hermetically sealed, with respect to the environment. For this purpose, the rotor can in particular be arranged in a pipe. The motor can, for example, be a canned motor.

In general, the motor can advantageously be a permanent magnet motor, in particular having a permanent magnet rotor.

The rotational speed of the side channel pump can advantageously be controllable via a frequency converter. The side channel pump can in this manner be adapted particularly easily and precisely to a respective application and also to specific operating states during a process.

Provision is made in accordance with an embodiment that a rotor or a rotor shaft of the side channel pump is supported by at least one grease-lubricated bearing. This enables a low-friction bearing operation without a complex and/or expensive additional lubrication system. In addition, the bearing can in this manner be designed as low in maintenance and substantially no operating medium exchange is necessary as would be the case with an oil lubrication under certain circumstances.

In general, the pump can have a seal, in particular a hermetic seal. In this respect, all the bearings for the rotor shaft are preferably arranged in the region of the recirculated gas, that is behind the seal from the viewpoint of the surrounding region. Grease-lubricated bearings in this respect in particular make it possible that the seal of the pump has to be broken as seldom as possible, at best not at all over the service life. The maintenance effort can hereby be considerably reduced since the restoration of a seal, in particular a hermetic seal, is usually very complex and/or expensive and requires special expertise. In addition, certain gases should not come into contact with the environment for various reasons. This is considerably facilitated by a low-maintenance pump. In general, the rotor, rotor shaft, motor rotor and/or bearing are preferably arranged in the region of the recirculated gas.

A further subject of the invention is a system comprising a process device having a space and/or a line for receiving a gas; and a recirculation device of the kind described above by which the gas can be removed from the process device and can be returned into the process device.

The process device is generally configured to carry out a process, wherein the gas is relevant to the process in some way. In general, the gas does not have to be the subject of the process. The gas can also merely be catalytic or have another effect, e.g. it can be a temperature control medium. The gas can be a substantially pure gas or also a gas mixture such as air. The gas can generally also include particles and/or droplets, for example.

The return of the gas can, for example, be carried out for the purpose of preparation, e.g. purification, temperature control, separation, and/or enrichment. The recirculation device can in particular have a correspondingly configured preparation device. However, the return can, for example, also be carried out substantially without influencing or changing the gas. In general, the gas can, for example, be removed at an outlet of the process device, in particular with only some of the gas flow being returned at the outlet, and/or the gas can, for example, be returned to an inlet of the process device, in particular with a further gas flow entering into the inlet.

The system can in particular be a closed system and/or a closed gas circuit can be provided.

The advantages of the invention are developed to a particular extent in a process device that comprises a laser. The laser can preferably be a gas laser, in particular an excimer laser or a CO2 laser.

A process device that comprises a temperature control apparatus, in particular an air conditioning apparatus and/or a cooling apparatus, is likewise advantageous. In this respect, a gas circulation can, for example, be effected by means of the recirculation device. The temperature control effect of the apparatus can hereby be improved, wherein the advantages in accordance with the invention are particularly well utilized.

The process device can, for example, comprise a fuel cell that can e.g. be used for power generation, for example, for driving a vehicle engine. The recirculation device can advantageously be provided to return excess process gas of the fuel cell, in particular hydrogen.

In accordance with a further advantageous example, the process device comprises a combustion device, in particular an internal combustion engine, for example of a vehicle drive. In this respect, the recirculation device can, for example, be provided to return an exhaust gas of the combustion device, in particular to an inlet of the combustion device.

Generally, the process device can therefore advantageously be part of a vehicle drive. Further generally, the process device can, for example, comprise any desired kind of reactor, e.g. a fuel cell or a combustion device, having at least partly gaseous emissions.

Finally, all the embodiments and individual features described with respect to the recirculation device can be used for an advantageous further development of the system and vice versa.

A further subject of the invention is the use of a side channel pump as a recirculation pump of a recirculation device for a gas of a process device, in particular of a recirculation device in accordance with the invention as is disclosed herein, and in particular of a recirculation device that is a component of a system in accordance with the invention as is disclosed herein.

BRIEF DESCRIPTION OF THE DRAWINGS

The invention will be explained only by way of example in the following with reference to the schematic drawing.

DETAILED DESCRIPTION OF THE INVENTION

Figure 1:
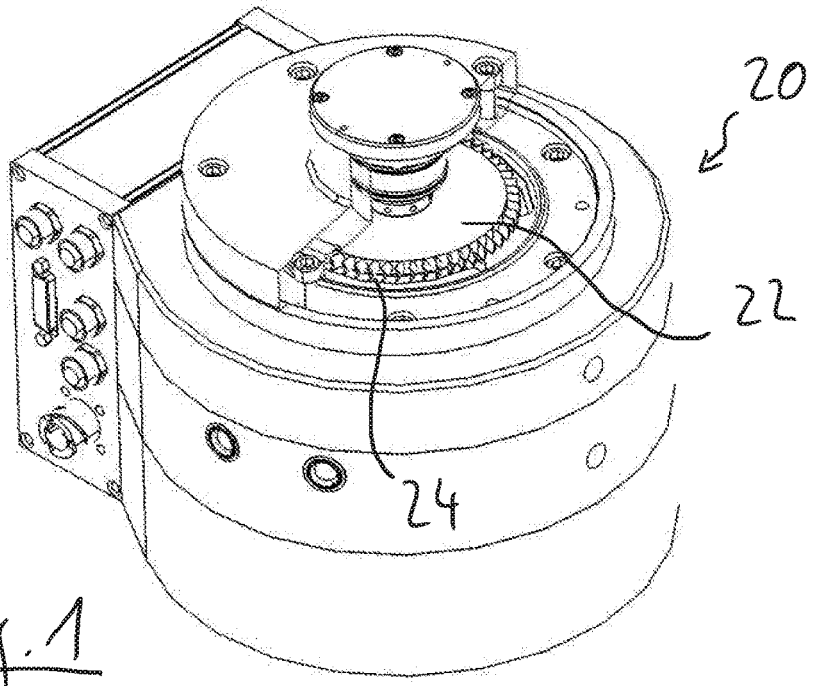
FIG. 1 shows a side channel pump in a perspective view.
Figure 2:
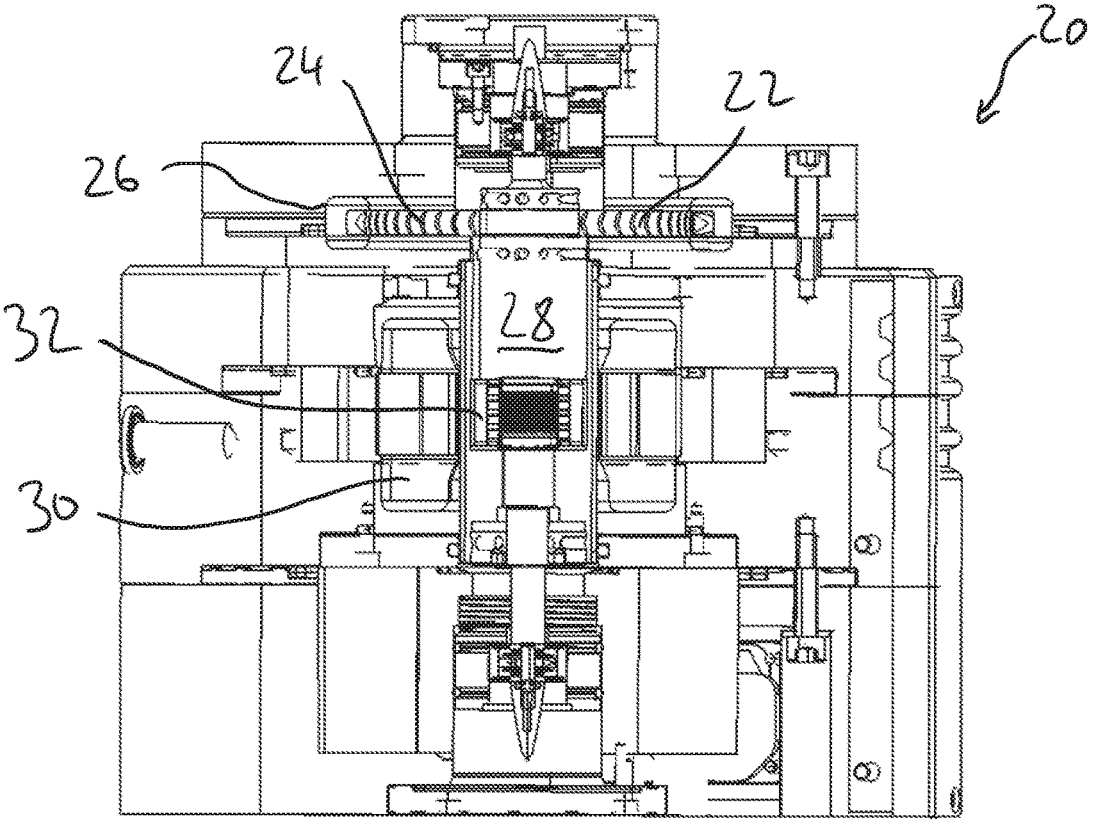
FIG. 2 shows the side channel pump of FIG. 1 in a sectional view.

FIG. 1 shows a side channel pump 20 for use as a recirculation pump in a recirculation device in accordance with the invention for a gas of a process device. The pump 20 is shown in isolation in the top region so that a rotor 22 is visible that rotates to provide a pumping effect. It can be seen from FIG. 2 that the pump 20 has only one rotor 22, i.e. it has a single-stage design. The rotor 22 rotates with a plurality of rotor blades 24 distributed over its periphery in a side channel 26. The side channel 26 is an annular channel that is slightly larger in its cross-section than a respective rotor blade. In the present embodiment, the side channel 26 is substantially rectangular in cross-section, but is designed with rounded corners.

The rotor 22 is arranged on a shaft 28 of the side channel pump 20. The shaft 28 and thus the rotor 22 are rotationally driven via an electric motor that comprises a stator 30 and a rotor 32. The stator 30 has energized windings, whereas the rotor 32 in this embodiment has a plurality of permanent magnets. The rotor 32 is fixedly connected to the shaft 28. The shaft 28 and thus the rotor 22 are therefore directly driven by the electric motor 30, 32.

In this embodiment, the rotor 22 is designed with curved rotor blades 24 slightly obliquely inclined to the rear in the direction of movement and with a flat intermediate space between the rotor blades 24.

Figure 3:
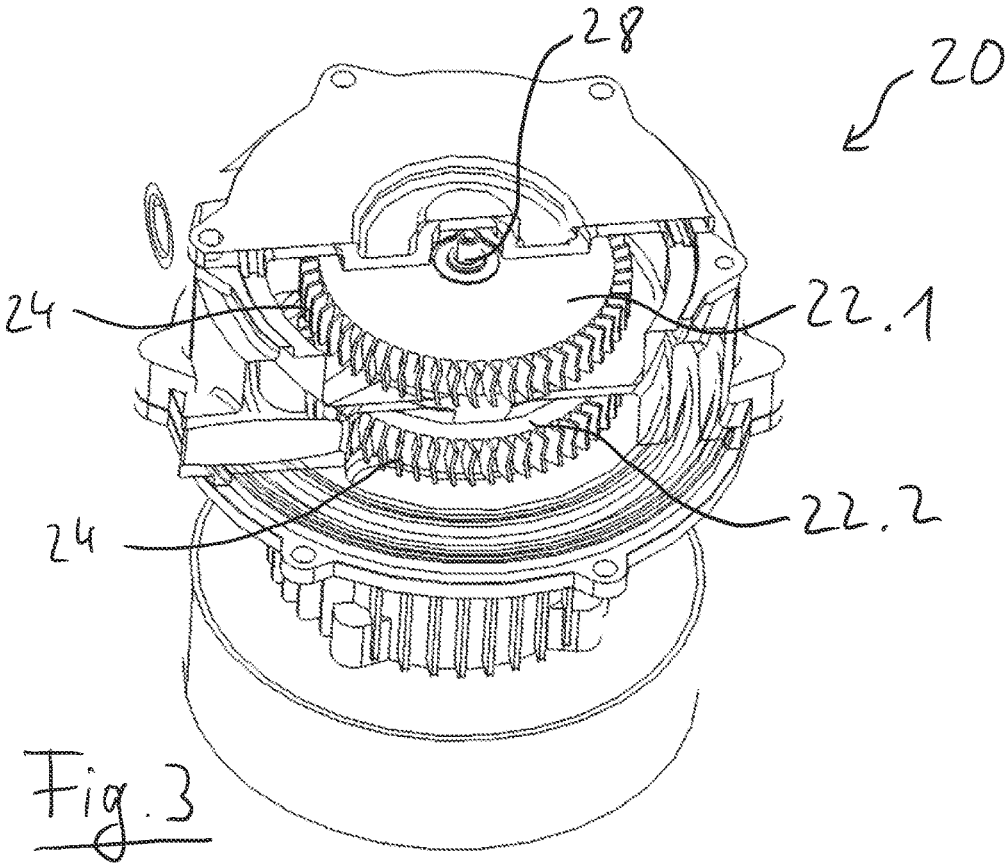
FIG. 3 shows a further side channel pump in a perspective view.
Figure 4:
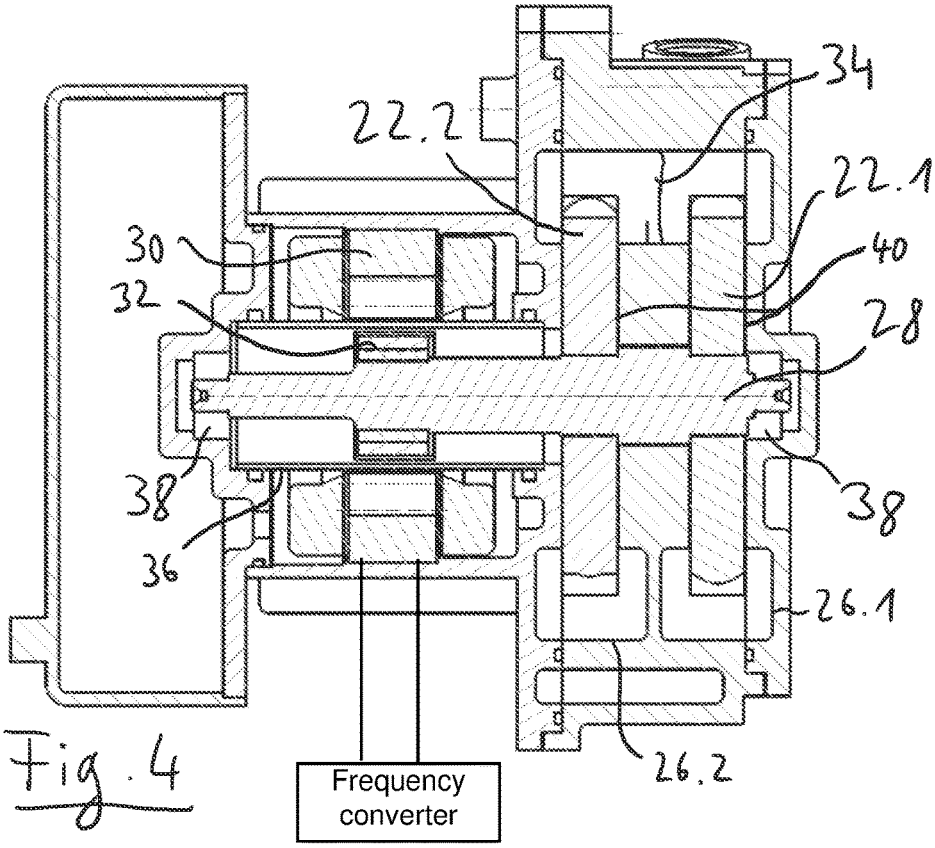
FIG. 4 shows the side channel pump of FIG. 3 in a sectional view.

FIGS. 3 and 4 show a two-stage side channel pump 20 that has two rotors 22.1 and 22.2 that are supported on a common shaft 28. The rotors 22.1 and 22.2 rotate in respective side channels 26.1 and 26.2 that here likewise have a substantially rectangular cross-section. A connection 34 of the side channels 26.1 and 26.2 can be seen in the top region of FIG. 4.

The rotors 22.1 and 22.2 each have arrow-shaped blades 24 that are slightly obliquely inclined to the rear in the direction of movement. In the intermediate spaces of the blades 24, the rotor 22 is flat in each case. The direction of movement here preferably extends in the direction of the tips of the respective arrow-shaped blades 24. In general, however, a reverse operation is also possible, for example.

The shaft 28 that carries the rotors 22 is driven by an electric motor. The electric motor has a stator 30 that has windings and a permanent magnet rotor 32 that is seated on the shaft 28. The rotor 32 and the shaft 28 are arranged within a pipe 36 that is part of a hermetic seal of the pump 20. Such a pipe 36 is also designated as a can because it extends through the gap between the rotor 32 and the stator 30 of the electric motor. Accordingly, the electric motor is designated as a canned motor. The can 36 can, for example, be manufactured from a glass fiber composite. The rotor 32 and the shaft 28 are located behind the hermetic seal from the viewpoint of the environment and in a region that is substantially passed through by the gas to be conveyed by the pump and that has a corresponding pressure level.

Two bearings 38 are furthermore located behind the seal or in the region of the gas to be conveyed. They are preferably grease-lubricated and/or permanently lubricated.

The functional elements arranged in the gas region or behind the seal are therefore substantially independently functional. They in particular do not have to be supplied in a wired manner, for instance, with power or an operating medium. The rotors 22 moreover run contactlessly in the housing gaps 40 provided for them. The functional parts in the gas region are thus extremely low-wear and low-maintenance. The hermetic seal of the pump 20 therefore only has to be broken extremely rarely during a dismantling in order to service the pump.

Figure 5:
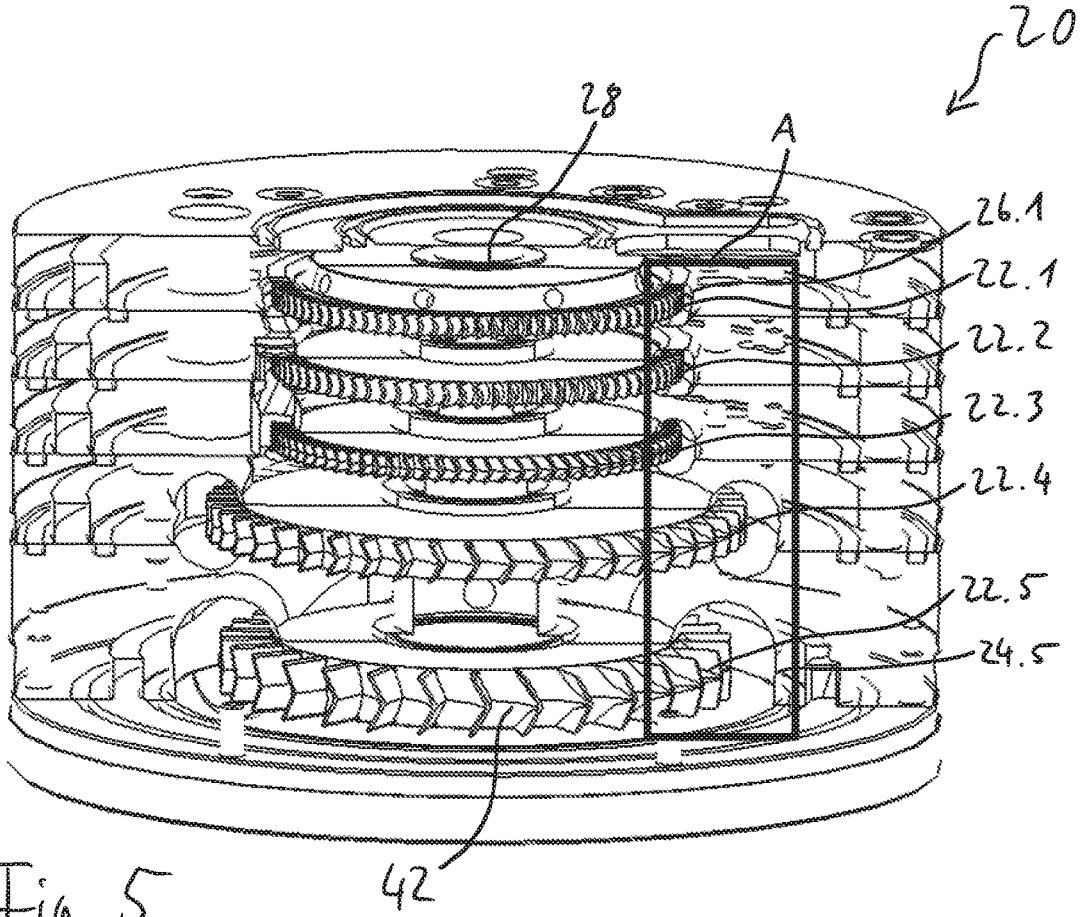
FIG. 5 shows a third embodiment of a side channel pump in a perspective sectional view.

A third embodiment of a side channel pump 20 is shown in FIG. 5. The side channel pump 20 has five stages, that is, five rotors 22 are provided that rotate in respective side channels 26. The rotors 22 are again arranged on a common shaft 28. A region A of the side channel pump 20 indicated in FIG. 5 is shown enlarged and rotated by 90 degrees in FIG. 6.

Figure 6:
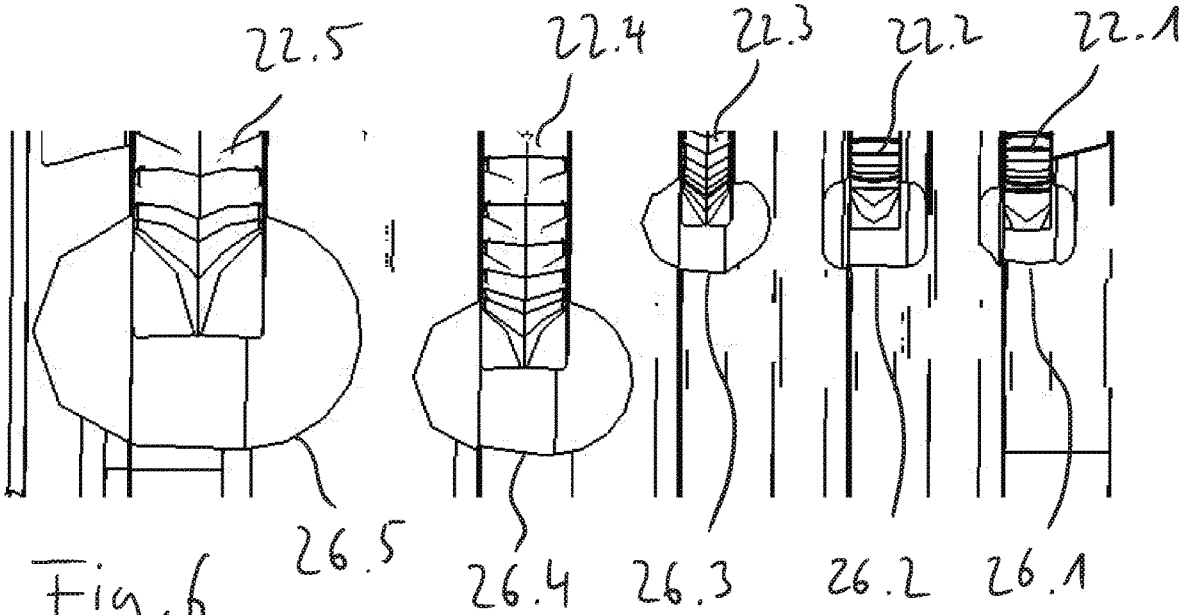
FIG. 6 shows a part region of the side channel pump enlarged with respect to FIG. 5 in a sectional view.

It can be seen from FIG. 6 that the side channels 26.1 and 26.2 of the first two pump stages are substantially rectangular, whereas the side channels 26.3, 26.4 and 26.5 of the remaining pump stages have a substantially oval or egg-shaped cross-section. As can in particular be seen from FIG. 5, the rotors 22.1 and 22.2 each have curved rotor blades. In contrast, the rotors 22.3, 22.4 and 22.5 are arrow-shaped. The rotors 22.3, 22.4 and 22.5 furthermore have a pointed roof-shaped structure 42 in the respective intermediate spaces between adjacent rotor blades 24 that supports the pumping effect by promoting a vortex formation of the gas flow in the side channel 26.

Different advantageous embodiments of rotors 22 are shown in FIGS. 7 to 12. The rotor 22 of FIG. 7 has curved rotor blades 24 having flat intermediate spaces.

Figure 8:
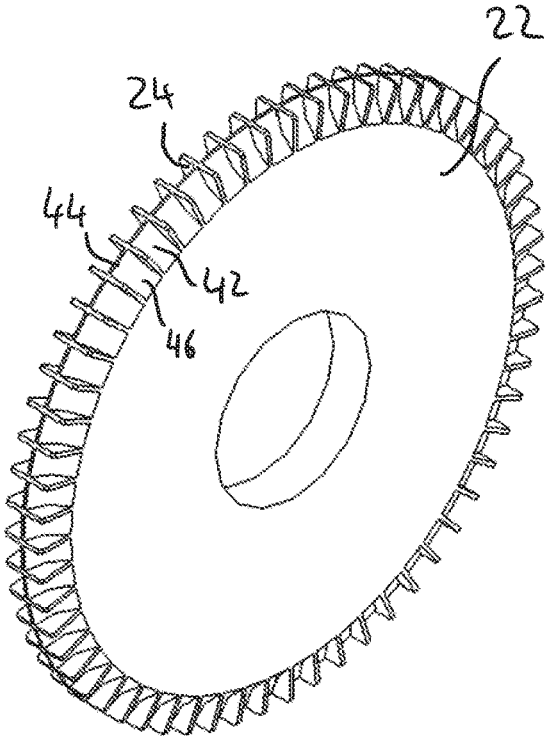

The rotor 22 of FIG. 8 has planar rotor blades 24 that extend radially. Roof-like structures 42 are respectively provided between the rotor blades 24, with a respective ridge edge 44 extending in parallel with the direction of movement of the rotor blades 24. The ridge edge 44 connects radially outer ends of the blades 24 in so doing. They are thus connected rotor blades 24. The surfaces 46 converging toward the ridge edge 44 are concave.

Figure 9:
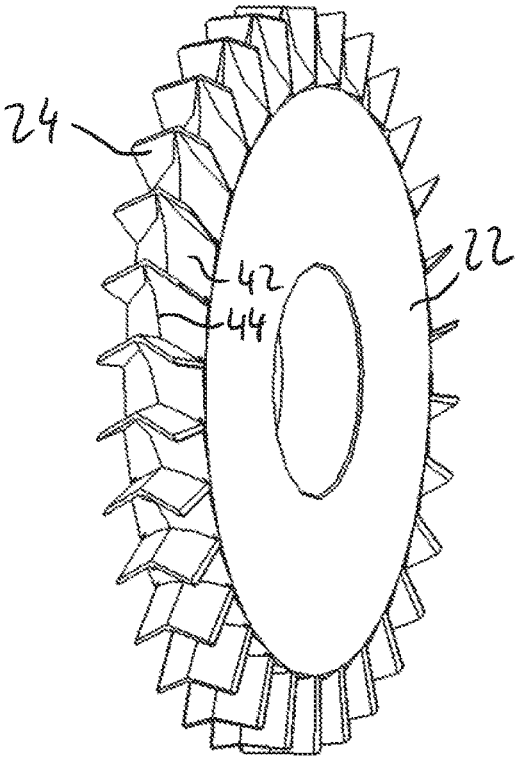
Figure 10:
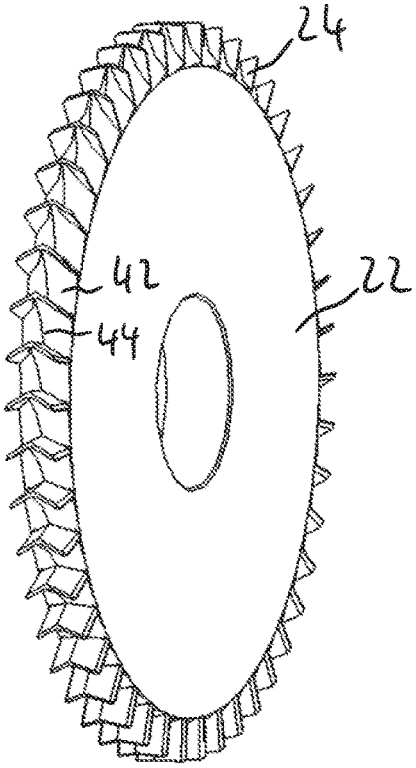
Figure 11:
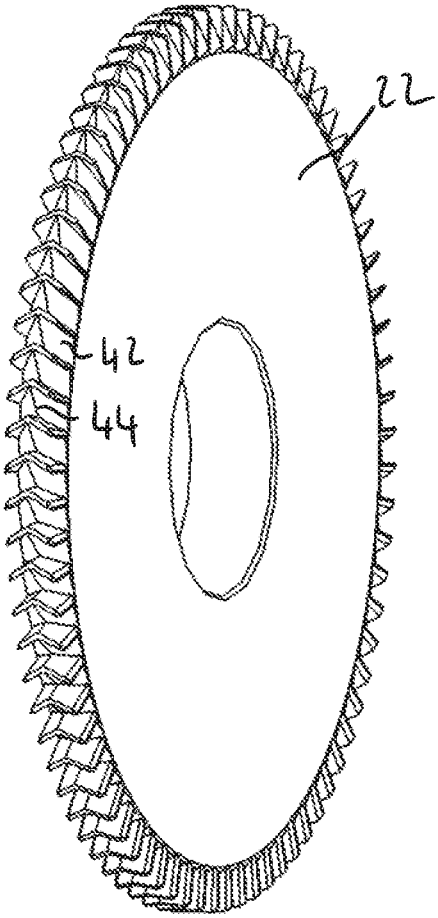

The rotors 22 of FIGS. 9 to 11 are all arrow-shaped and substantially differ in size, the number of blades, or the relative blade spacing. They additionally have a roof-like structure 42 having a respective ridge edge 44 in the intermediate blade spaces. In this respect, the ridge edges 44 of the rotors 22 of FIGS. 9 and 10 are curved themselves, whereas the ridge edge 44 in FIG. 11 is substantially straight. All the ridge edges 44 of FIGS. 9 to 11 extend from a respective blade tip to a base of an adjacent blade. The rotor blades 24 are thus not connected.

Figure 7:
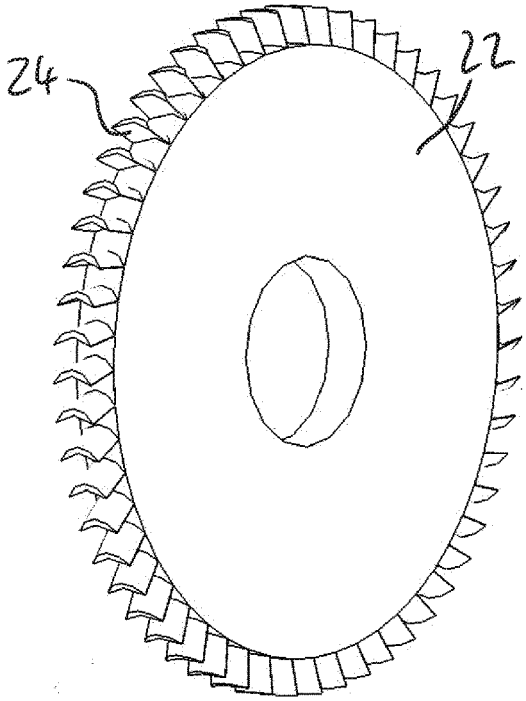
FIGS. 7 to 12 show different embodiments of rotors for a side channel pump.
Figure 12:
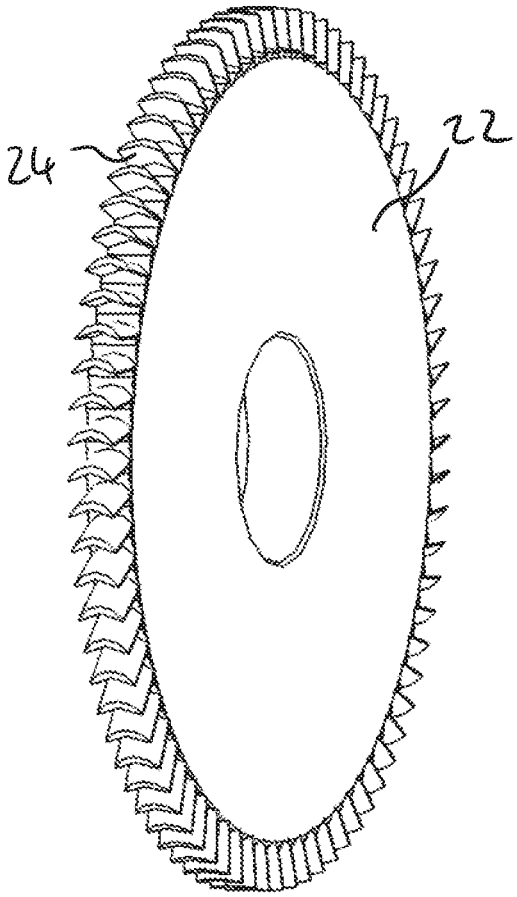

The blades 24 of the rotor 22 of the embodiment shown in FIG. 12 are finally curved, wherein they in particular differ from the embodiment of FIG. 7 with respect to number and size.

Figure 13:
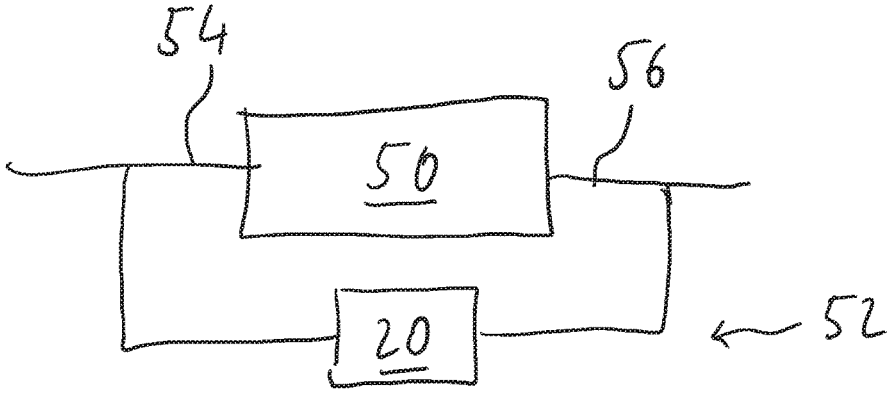
FIGS. 13 to 15 show different systems with a process device and a recirculation device.

A system having a process device 50 and a recirculation device 52 is shown in FIG. 13, wherein the recirculation system 52 has a recirculation pump configured as a side channel pump 20. The process device 50 has an inlet 54 and an outlet 56. The inlet 54 is connected to the recirculation device 52 such that a returned gas is returned into the inlet 54. In addition, a further mass flow is supplied to the inlet 54 via a further line. Similarly, the outlet 56 is connected both to the recirculation device 52 or the side channel pump 20 and to a further line that takes up a partial mass flow of the outlet 56. In the system of FIG. 13, a portion of a mass flow that passes through the process device is therefore recirculated. The process device 50 can, for example, be a fuel cell. In this case, the mass flow can include hydrogen, for example. Excess hydrogen that has not been consumed by the fuel cell is returned to the inlet 54 via the recirculation device 52 in order to be consumed after all. The efficiency of the fuel cell can thus be improved. A separator can in particular be provided connected downstream of the outlet 56 and supplies as large as possible a portion of the excess hydrogen to the side channel pump 20.

The process device 50 of the system of FIG. 13 can, for example, also be a combustion device such as an internal combustion engine. In this respect, the recirculation device 52 forms an exhaust gas return by removing exhaust gas from the mass flow of the outlet 56 and returning it into the supply air flow at the inlet 54.

Figure 14:
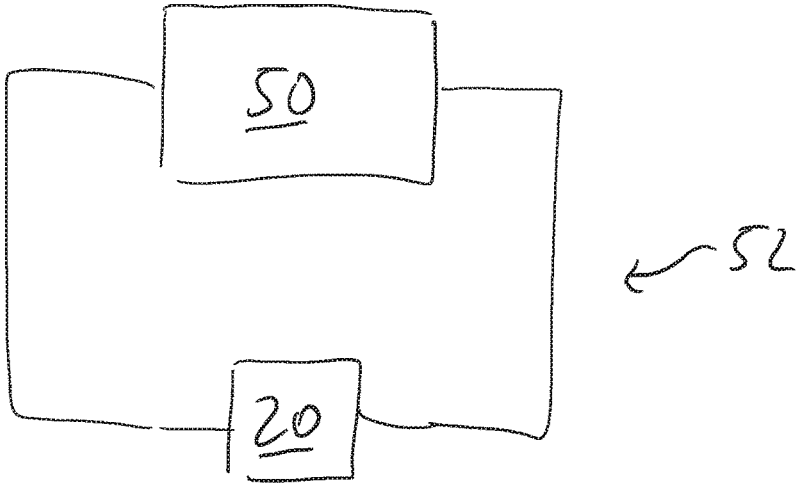

FIG. 14 shows a system that is closed with respect to the gas flow and that has a process device 50 and a recirculation device 52 having a side channel pump 20. The gas present in the process device 50 can, for example, be circulated via the recirculation device 52 and its side channel pump 20 in order to avoid a phase formation of a gas mixture in the process device.

Figure 15:
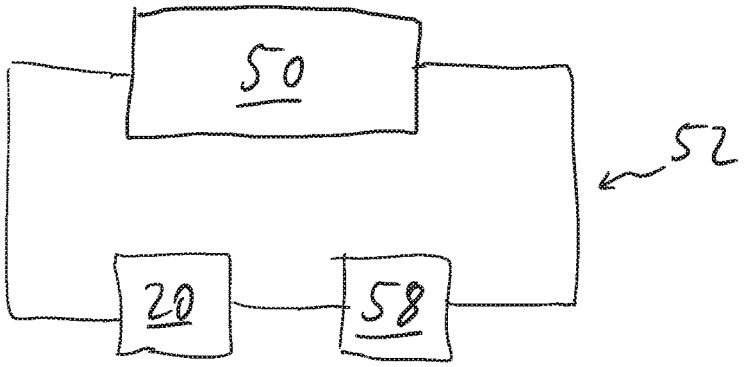

FIG. 15 shows a further system that is closed with respect to the gas flow. This system likewise comprises a process device 50; a recirculation device 52; and a side channel pump 20. The recirculation device 52 of FIG. 15 additionally comprises a preparation device 58 for preparing the returned gas. The preparation device 58 can, for example, be configured for the purification and/or temperature control of the gas. A preparation device can, for example, be a part of the recirculation device of FIG. 13. To the extent that closed systems are spoken of in connection with the systems of FIGS. 14 and 15, it is understood that the purely schematic drawings do not exclude further gas systems and line systems.

Only embodiments in which the side channels or the side channel pump stages are arranged axially offset are shown in the Figures. It is understood that the side channel pump of the recirculation device in accordance with the invention can also, for example, have radially offset side channel pump stages. A combination of axially and radially offset stages is also possible. Finally, the side channel pump can also be advantageously connected to pump stages that have other pumping principles.

REFERENCE NUMERAL LIST

20 side channel pump
22 rotor
24 rotor blade
26 side channel
28 shaft
30 stator
32 rotor
34 connection
36 can
38 bearing
40 gap
42 pointed roof-shaped structure
44 ridge edge
46 surface
50 process device
52 recirculation device
54 inlet
56 outlet
58 preparation device

What is claimed:

1. A recirculation device for a gas of a process device, said recirculation device comprising: a recirculation pump, wherein the recirculation pump is a side channel pump which includes a rotor having a plurality of rotor blades; wherein an intermediate space between two rotor blades adjacent in a direction of movement has a pointed roof-shaped structure defining a ridge edge, wherein each ridge edge extends from a respective blade tip to a base of an adjacent blade, such that the adjacent rotor blades are not connected with each other via the roof-shaped structure.

2. The recirculation device in accordance with claim 1, wherein the gas includes at least one of hydrogen, a temperature control medium, and $CO_2$.

3. The recirculation device in accordance with claim 1, wherein the rotor blades are each at least one of straight, oblique, arrow-shaped, curved, divided, undivided, or inclined to the front or to the rear in the direction of movement.

4. The recirculation device in accordance with claim 1, wherein at least one side channel of the side channel pump has a circular, oval, elliptical, rectangular, or egg-shaped cross-sectional geometry.

5. The recirculation device in accordance with claim 1, wherein at least one side channel of the side channel pump tapers in its cross-section in a flow direction.

6. The recirculation device in accordance with claim 1, wherein the side channel pump has a single-stage or multi-stage design.

7. The recirculation device in accordance with claim 1, wherein the side channel pump has a sealed region; and wherein parts of the pump that are movable to produce the pumping effect are arranged within the sealed region.

8. The recirculation device in accordance with claim 1, wherein the rotational speed of the side channel pump is controllable via a frequency converter.

9. The recirculation device in accordance with claim 1, wherein the rotor of the side channel pump is supported by at least one grease-lubricated bearing.

10. A system comprising a process device having a space and/or a line for receiving a gas; and a recirculation device by which the gas can be removed from the process device and can be returned into the process device, said recirculation device comprising a recirculation pump, wherein the recirculation pump is a side channel pump which includes a rotor having a plurality of rotor blades; wherein an intermediate space between two rotor blades adjacent in a direction of movement has a pointed roof-shaped structure defining a ridge edge, wherein each ridge edge extends from a respective blade tip to a base of an adjacent blade, such that the adjacent rotor blades are not connected with each other via the roof-shaped structure.

11. The system in accordance with claim 10, wherein a closed gas circuit is provided.

12. The system in accordance with claim 10, wherein the process device comprises a laser.

13. The system in accordance with claim 10, wherein the process device comprises a temperature control apparatus.

14. The system in accordance with claim 10, wherein the process device comprises a fuel cell.

15. The system in accordance with claim 10, wherein the process device comprises a combustion device.

* * * * *